US007063549B1

(12) United States Patent
Chen

(10) Patent No.: US 7,063,549 B1
(45) Date of Patent: Jun. 20, 2006

(54) ELECTRIC CONNECTION ASSEMBLY FOR POWER SUPPLY WITH INTERLOCKING COMPONENTS

(75) Inventor: Michael Chen, Taipei Hsien (TW)

(73) Assignee: Topower Computer Industrial Co., Ltd., Xindian (TW)

( * ) Notice: Subject to any disclaimer, the term of this patent is extended or adjusted under 35 U.S.C. 154(b) by 0 days.

(21) Appl. No.: 11/013,476

(22) Filed: Dec. 17, 2004

(51) Int. Cl.
*H04R 13/52* (2006.01)
*H04R 13/62* (2006.01)
*H04R 4/38* (2006.01)

(52) U.S. Cl. ..... 439/277; 439/320

(58) Field of Classification Search ..... 439/589, 439/281, 277, 271, 320
See application file for complete search history.

(56) References Cited

U.S. PATENT DOCUMENTS 3,963,297 A * 6/1976 Panek et al. ..... 439/204
4,230,390 A * 10/1980 Wells ..... 439/314
4,239,325 A * 12/1980 Tyson ..... 439/314
4,758,174 A * 7/1988 Michaels et al. ..... 439/281
6,135,800 A * 10/2000 Majors ..... 439/321
6,585,533 B1 * 7/2003 Sullivan et al. ..... 439/254
6,623,289 B1 * 9/2003 Decicco ..... 439/271

* cited by examiner

*Primary Examiner*—Chandrika Prasad
(74) *Attorney, Agent, or Firm*—Birch, Stewart, Kolasch & Birch, LLP

(57) ABSTRACT

The present invention relates to a electric connection assembly of power supply, which comprises a first component connectively installed to the power supply and a second component connectively installed to the power cord, wherein a male and a female connector, which mate each other, are separately installed in the first and the second component, and further, a first securing member and a corresponding second securing member are separately installed in the first and the second component to form a securing mechanism in order to prevent the power cord from being inappropriately dragged, so that the electric engagement is secured and the electric performance is stabilized.

16 Claims, 6 Drawing Sheets

ELECTRIC CONNECTION ASSEMBLY FOR POWER SUPPLY WITH INTERLOCKING COMPONENTS

FIELD OF THE INVENTION

The present invention relates to an electric connection assembly of power supply, particularly to an electric connection assembly of power supply, which adopts a design of detachable electric connection, and provides a securing mechanism to enable a power cord to be firmly engaged with the power supply so that the electric performance can be secured.

BACKGROUND OF THE INVENTION

The power supply, which provides electric power, is one of the most important components in the current electronic products. In addition to the power specification, the capability of the power supply to have a stable electric performance is also a primary consideration of the consumer.

In the technical aspect, each manufacturer of the current power supply has its own achievements in the output power and the appearance design; however, with respect to the power cord, none improved design has been put forward by the related manufacturers yet, and the conventional power cord is apt to make the user troublesome sometimes; the drawbacks thereof are described as follows:

1. The conventional power cord has a plurality of power wires, which exit from the same outlet, as shown in FIG. 1; however, the user needs only part of the power wires ordinarily; thus, the arrangement of the rest of those power wires becomes a troublesome matter; moreover, the interior space of the current computer becomes narrower and narrower, and the high-speed operation of the electronic component, such as CPU, generates a large amount of heat, the rest of those power wires will make the interior space of the computer further narrower, which makes the heat harder to dissipate; thus the computer performance is impaired seriously by the accumulated heat.
2. There is an insert type power cord to improve the abovementioned drawback, wherein an insert socket and an insert plug are separately installed in the power supply and the power cord for electric connection, and the user can connect appropriate numbers of power wires according to the power demand; however, owing the abovementioned narrow interior space of the computer, the power cord is apt to be dragged inadvertently when assembling or disassembling the electronic devices, which will result in the disconnection or the incomplete electric contact, and which will even result in the electric shock to the user; the wearing between the metallic terminals of the insert socket and plug will raise the impedance therebetween, and the power output of the power supply will thus be influenced.

SUMMARY OF THE INVENTION

The primary objective of the present invention is to provide an electric connection assembly of power supply in order to solve the aforementioned problems. The electric connection assembly of power supply of the present invention provides an effective securing mechanism to prevent the power cord from being dragged by an external force so that the descent of the electric performance induced thereby can be effectively avoided. The electric connection assembly of power supply of the present invention comprises a first component installed in the power supply and a second component installed in the power cord. A male and a female connector, which mate each other and are electrically engaged via an insertion means, are separately installed in the first and the second component. Further, a first securing member and a second securing are separately installed in the first and the second component in order to form a securing mechanism lest the power cord is dragged by the external force and the electric engagement of the male and the female connector be influenced.

Further scope of the applicability of the present invention will become apparent from the detailed description given hereinafter. However, it should be understood that the detailed description and specific examples, while indicating preferred embodiments of the invention, are given by way of illustration only, since various change and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein:

DETAILED DESCRIPTION OF THE PREFERRED EMBODIMENTS

The detailed description and technical contents of the present invention will be stated below in conjunction with the attached drawings.

Figure 1:
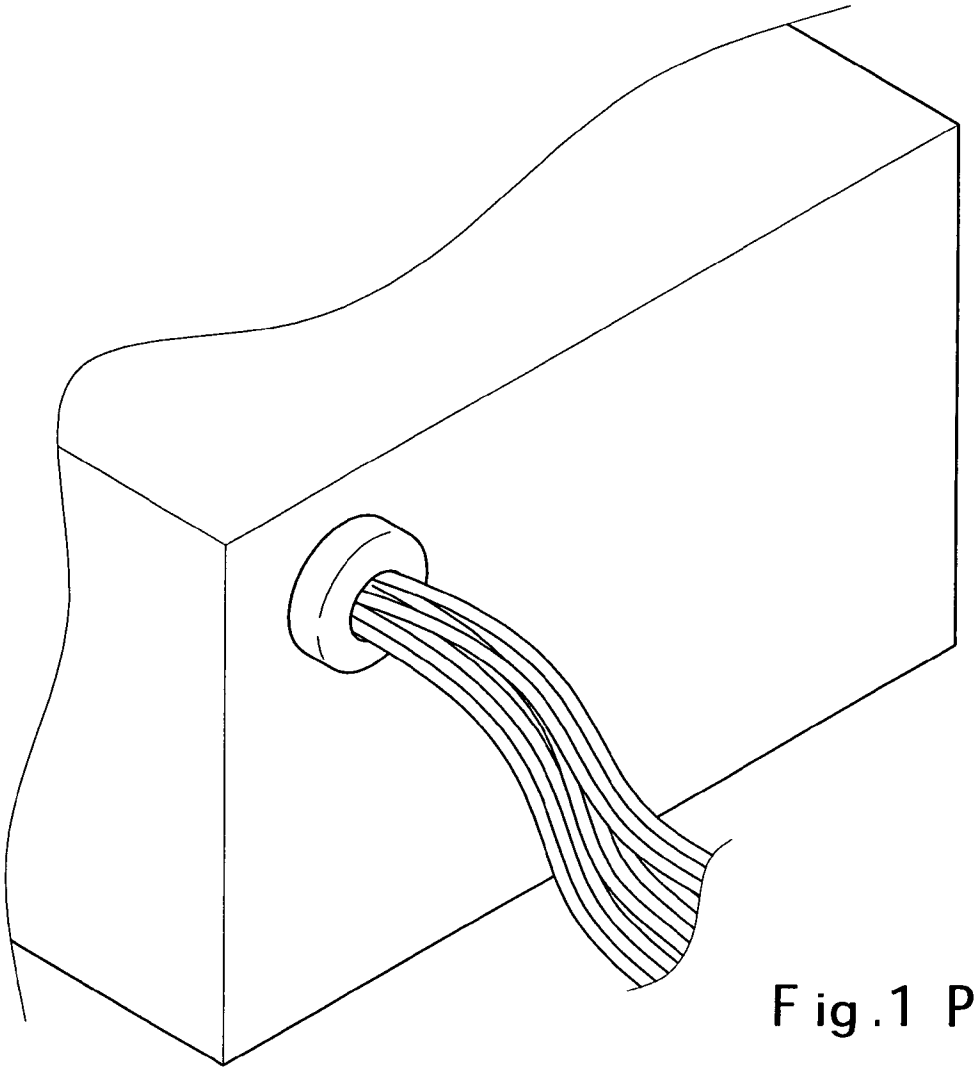
Fig.1 PRIOR ART
FIG. 1 is schematic diagram showing the power cord's connection in the conventional power supply.
Figure 2:
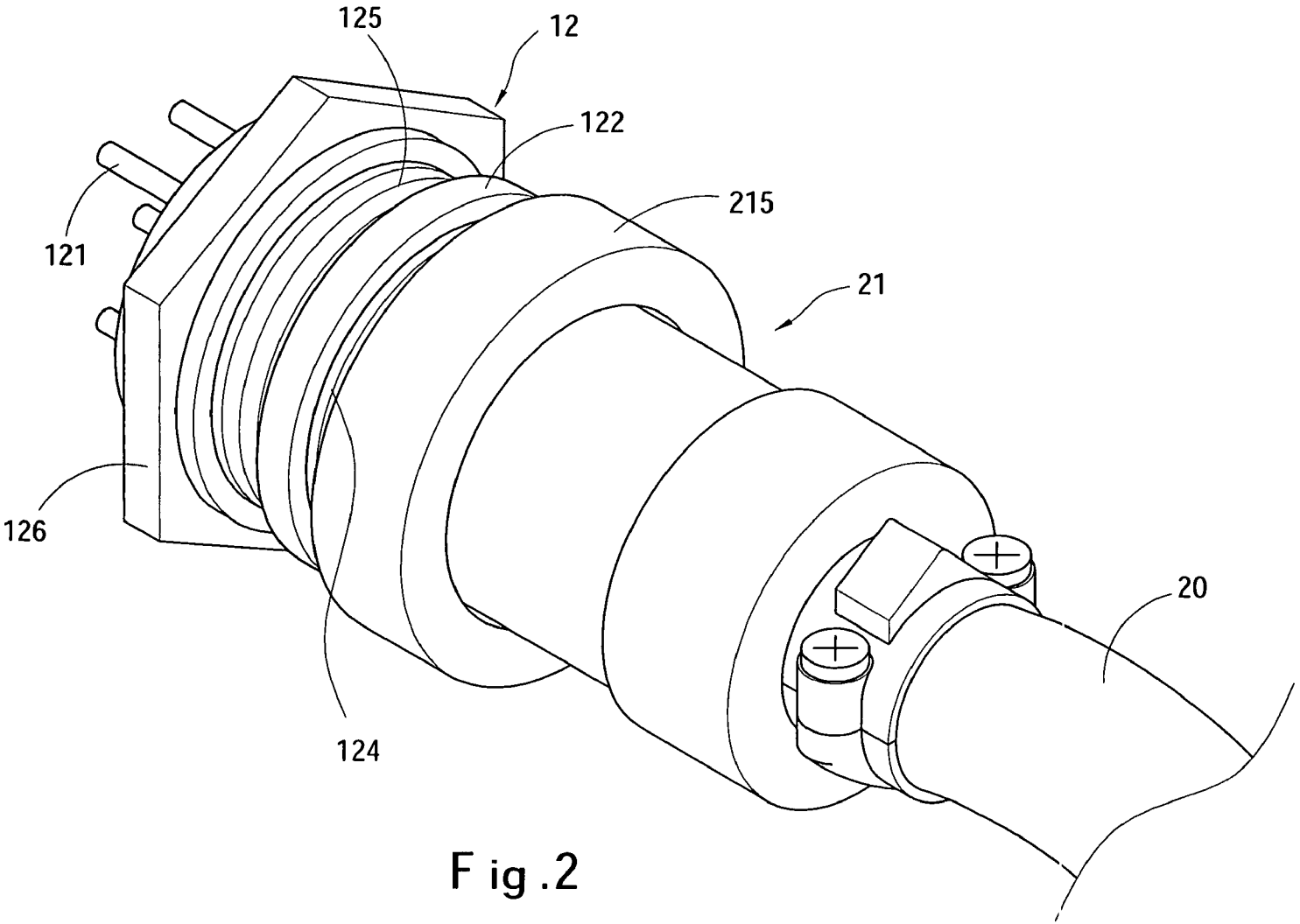
FIG. 2 is a schematic pictorial outside view of the present invention.
Figure 3:
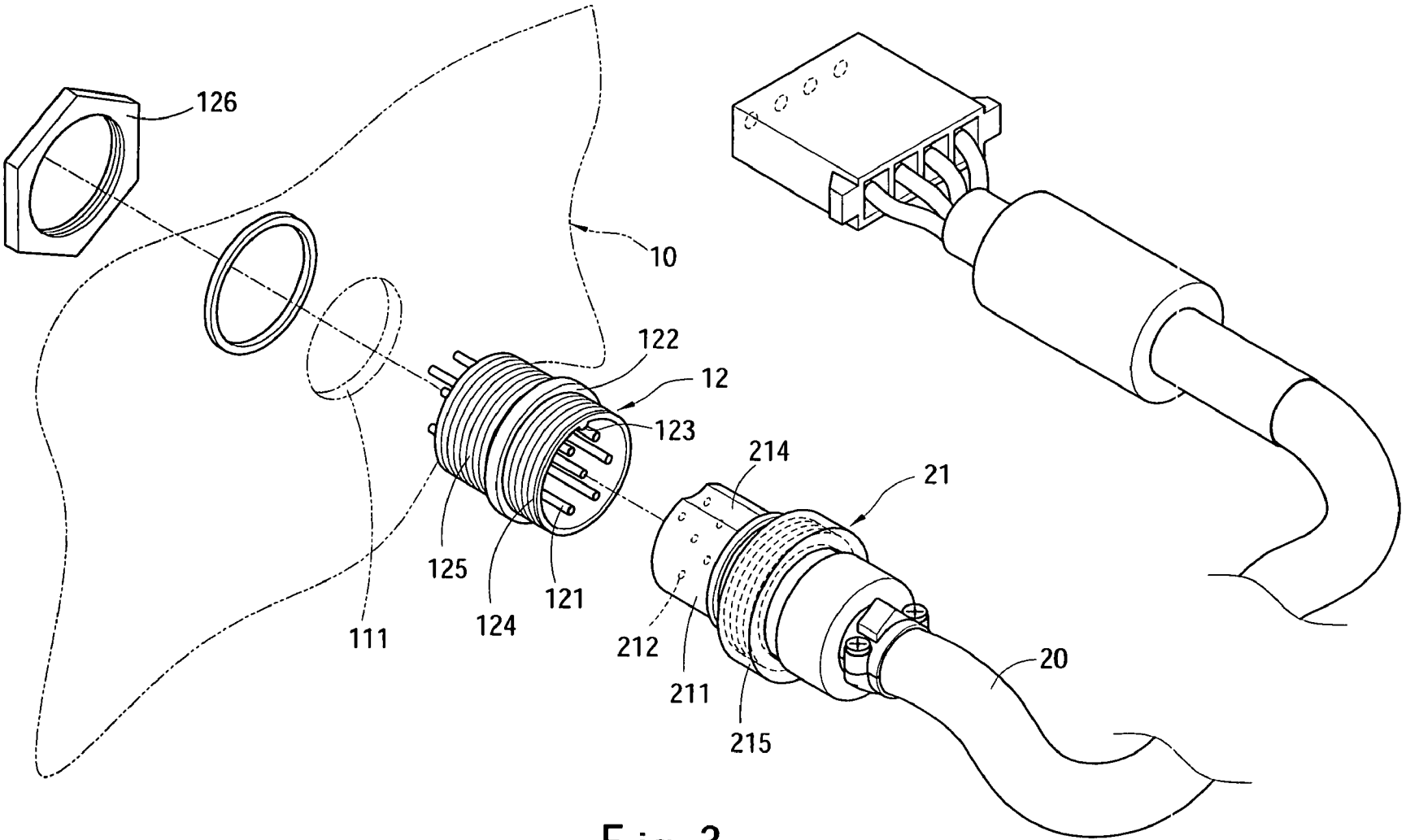
FIG. 3 is a schematic exploded structure view of the present invention.
Figure 5:
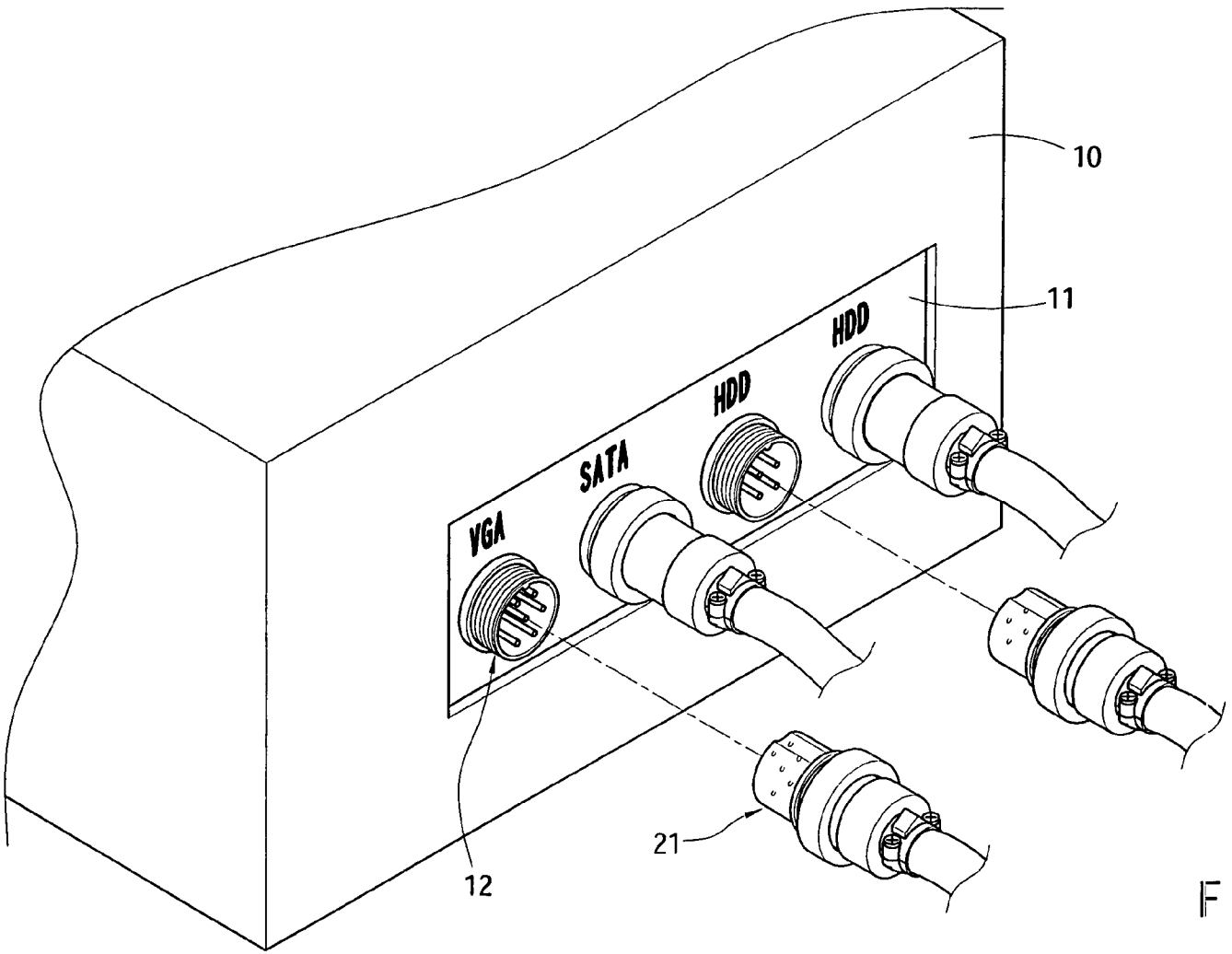
FIG. 5 is a schematic view showing the electric connection of the power supply and the power cord in the present invention.

Refer to FIG. 2, FIG. 3 and FIG. 5 separately the present invention's pictorial outside view, exploded structure view, and schematic diagram showing that a power cord 20 is electrically coupled to a power supply 10 by the present invention's electric connection assembly of power supply. As shown in the drawings, the present invention's electric connection assembly of power supply is disposed between the power supply 10 and the power cord 20 that is electrically coupled to the power supply 10. The electric connection assembly of power supply has a first component 12 connectively installed to the power supply 10 and a second component 21 connectively installed to the power cord 20; a male connector 121 and a female connector 211, which mate to electrically connect each other, are installed separately in the first component 12 and the second component 21. The male connector 121 comprises a plurality of electrical conductive terminals, whose number depends on invention, and the female connector 211 comprises a plurality of insert slots 212 with each having an interior electrical conductive terminal 213 corresponding to the respective electrical conductive terminal of the male connector 121. The first component 12 and the second component 21 separately have a first securing member 124 and a second securing member 215, which match to form a securing mechanism. A power-connecting panel 11, whereon the specifications of the power output can be labeled, is defined on the power supply 10, and corresponding to the number of the first components 12, a plurality of installing holes 111 of the same number as the first components 12 are disposed on the power-connecting panel 11. When assembling, the first components 12 are inserted and installed on the installing holes 111. The first component 12 has a detent ring 122; the end of the first component 12 in the interior of the power supply 10 is a fixing end 125, and a fixing element 126 is disposed on the fixing end 125; the engaging faces of the fixing element 126 and the fixing end 125 are both circumferentially threaded to screw each other together fixedly so that the first components 12 can be installed on the power supply 10 firmly.

Figure 4:
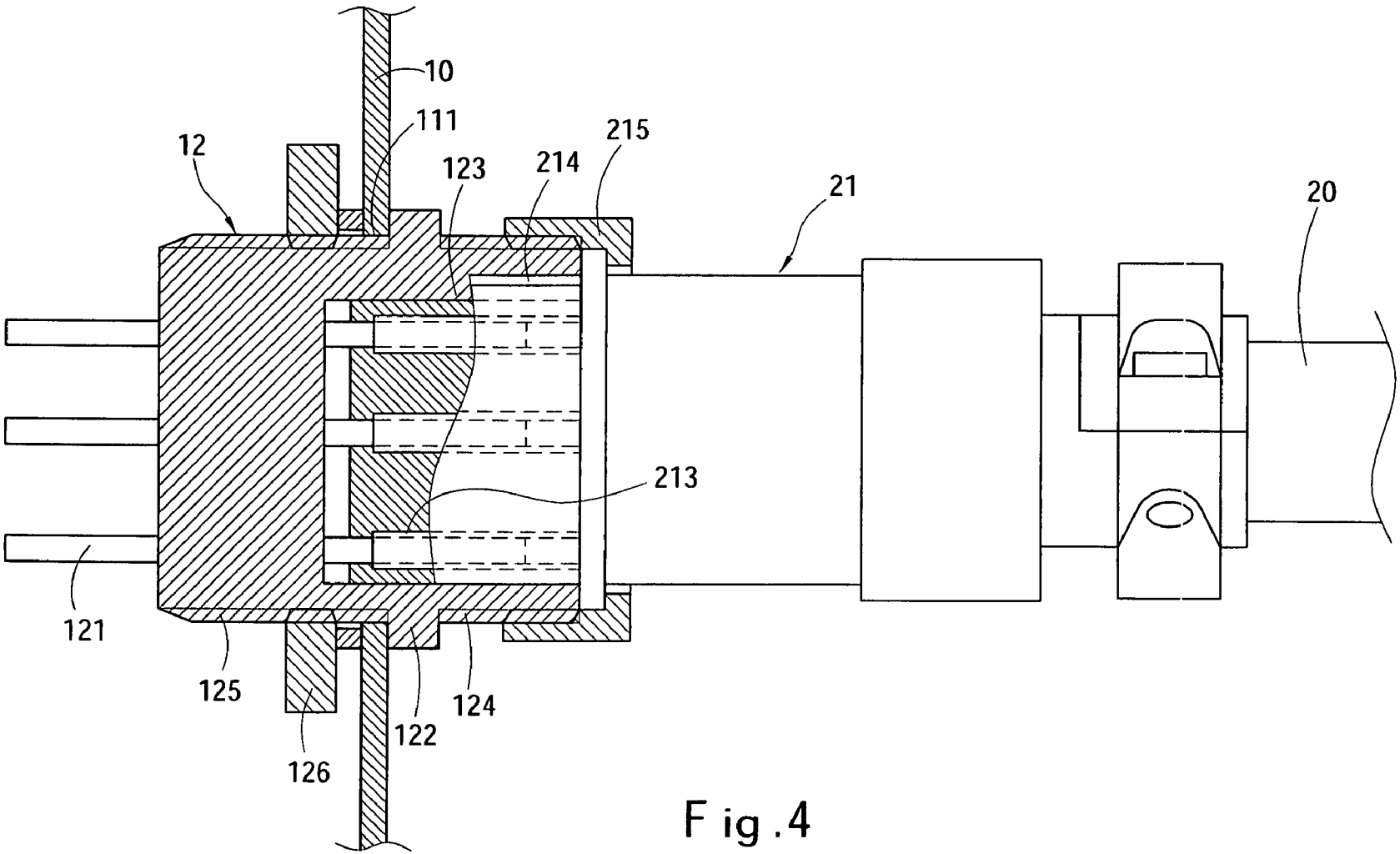
FIG. 4 is a schematic sectional assembly view of the present invention.

Refer also to FIG. 4. When the user undertakes the electric connection of the power cord 20 and the power supply 10, firstly the first component 12 is inserted to the second component 21 to join each other together. Owing to the foolproof design of a guide key 123 and a keyway 214 which are separately disposed on the male connector 121 and the female connector 211, the user can perform the electric engagement of the male connector 121 and the female connector 211 conveniently. The engaging faces of the first securing member 124 and the second securing member 215 are both circumferentially threaded, and the second securing member 215 can movably sleeve the second component 21 and then be screwed to engage with the first securing member 124; thus, the electric connection is completed.

Figure 6:
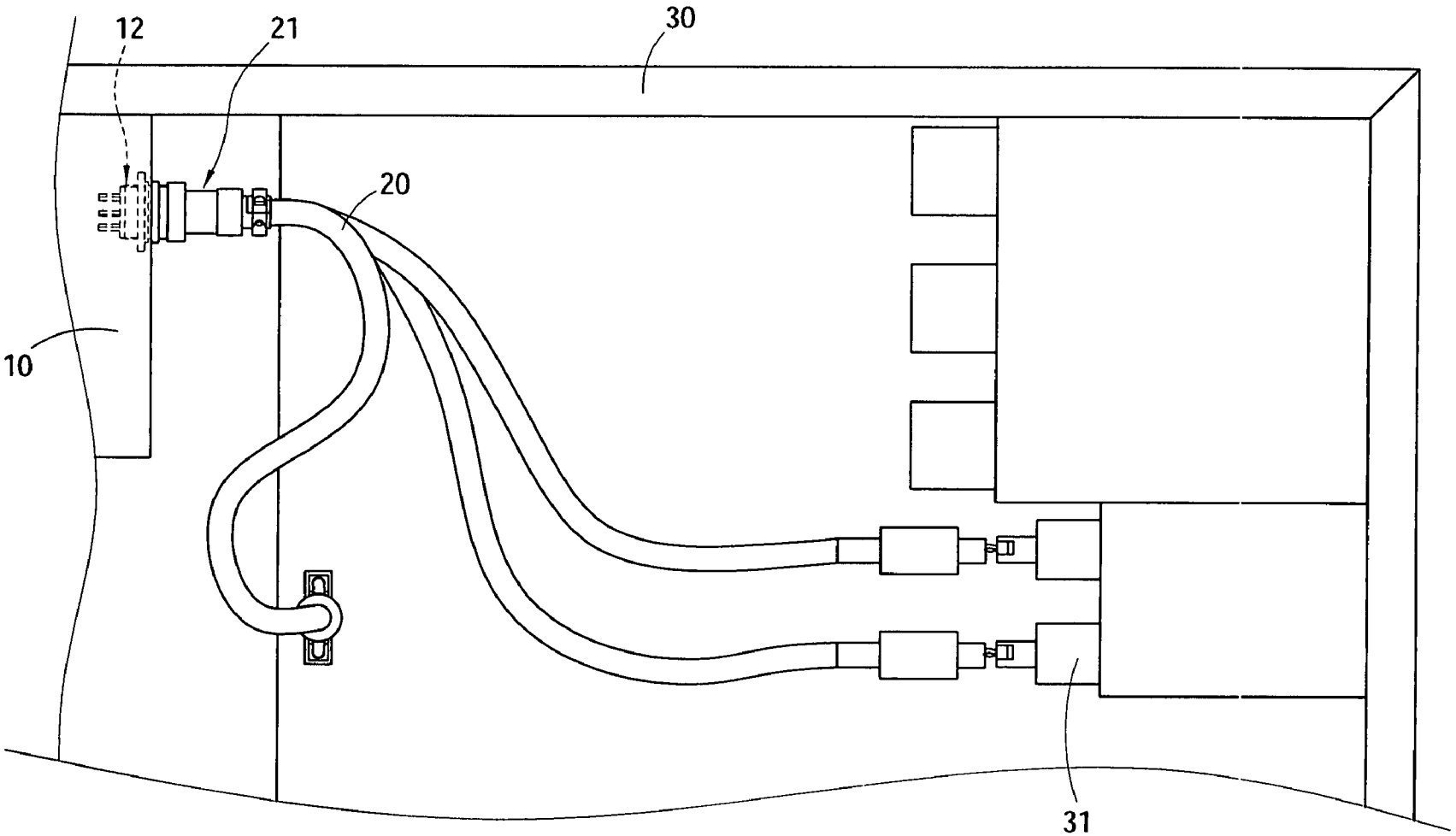
FIG. 6 is a schematic embodiment diagram showing electric connection assembly of power supply of the present invention installed in an electronic device.

As shown in FIG. 6, when the power supply 10 and the power cord 20 are disposed in an electronic device 30, if the user has to assemble or disassemble an electronic element 31, the power cord 20 is probably to be dragged inadvertently. As the electric connection assembly of power supply of the present invention has the securing mechanism with the first securing member 124 and the second securing member 215, the male connector 121 and the female connector 211, though only joined by insertion, will not yet be separated under the external dragging force; thus, the electric engagement of the power supply 10 and the power cord 20 is to be secured. Further, as there is not any wear between the male connector 121 and the female connector 211 induced by the dragging, the electric contact therebetween can be kept so that the power efficiency will be guaranteed.

Those described above are only the preferred embodiments of the present invention, and not intended to limit the scope of the present invention. Any modification and variation according to the claims of the present invention is to be included within the scope of the present invention.

What is claimed is:

1. An electric connection assembly of power supply, which is disposed between a power supply and a power cord to electrically connect said power supply and said power cord, said electric connection assembly of power supply comprising a first component connectively installed on said power supply and a second component connectively installed on said power cord, and a male connector and a female connector, which mate each other, separately installed in said first component and said second component, and a first securing member and a second securing member, which match to form a securing mechanism, separately installed in said first component and said second component, the first component being a one-piece, unitary element with an interior face from which the male connector extends and the female connector having a forward side which faces the interior face of the first component when the male and female connectors are mated.

2. The electric connection assembly of power supply according to claim 1, wherein said second securing member is movable over said second component.

3. The electric connection assembly of power supply according to claim 1, wherein the engaging faces of said first securing member and said second securing member are circumferentially threaded.

4. The electric connection assembly of power supply according to claim 1, wherein said male connector further comprises a plurality of electrical conductive terminals, and said female connector comprises a plurality of insert slots with each having an interior electrical conductive terminal corresponding to respective said electrical conductive terminal of said male connector.

5. The electric connection assembly of power supply according to claim 1, wherein a guide key and a corresponding keyway are separately installed in said male connector and said female connector.

6. The electric connection assembly of power supply according to claim 1, wherein the end of said first component in the interior of said power supply is a fixing end, and a fixing element is installed on said fixing end.

7. The electric connection assembly of power supply according to claim 6, wherein the engaging faces of said fixing element and said fixing end are circumferentially threaded.

8. The electric connection assembly of power supply according to claim 1, wherein a power-connecting panel is defined on said power supply, and a plurality of installing holes corresponding to said first components are disposed on said power-connecting panel.

9. The electric connection assembly of power supply according to claim 8, wherein said first component has a detent ring whose external diameter is larger than the diameter of said installing hole.

10. The electric connection assembly of power supply according to claim 1, wherein the interior face of the first component and the forward side of the female connector directly face one another and are free of obstructions therebetween.

11. The electric connection assembly of power supply according to claim 10, further comprising a free space provided between the interior face of the first component and the forward side of the female connector.

12. The electric connection assembly of power supply according to claim 11, further comprising a single guide key and a corresponding keyway separately installed in the male and female connectors.

13. The electric connection assembly of power supply according to claim 12, wherein the power connecting panel has a plurality of installing holes into which the first components are inserted, the holes being sized so that the first components directly contact the power connecting panel.

14. The electric connection assembly of power supply according to claim 13, wherein the male connector passes through the interior face of the first component but the first component otherwise is closed.

15. The electric connection assembly of power supply according to claim 1, further comprising a free space provided between the interior face of the first component and the forward side of the female connector.

16. The electric connection assembly of power supply according to claim 1, wherein the male connector passes through the interior face of the first component but the first component otherwise is closed.

* * * * *